US006134992A

United States Patent [19]

Perkins

[11] Patent Number: 6,134,992

[45] Date of Patent: Oct. 24, 2000

[54] FASTERNER REMOVING TOOL

[76] Inventor: Leland M. Perkins, 2434 La Granada, Thousand Oaks, Calif. 91362

[21] Appl. No.: 09/400,691

[22] Filed: Sep. 21, 1999

[51] Int. Cl.[7] ..... B25B 13/32

[52] U.S. Cl. ..... 81/90.5; 81/90.9; 81/116; 279/108

[58] Field of Search ..... 81/81, 90.2–90.7, 81/90.9, 91.3, 92–94, 97, 99, 106, 111–116; 279/36, 108

[56] References Cited

U.S. PATENT DOCUMENTS

| | | | |
|---|---|---|---|
| 1,954,444 | 4/1934 | Early | 81/116 |
| 2,719,445 | 10/1955 | Giebler | 81/114 X |
| 2,993,394 | 7/1961 | Scott . | |
| 3,323,395 | 6/1967 | Burnett et al. . | |
| 3,603,132 | 9/1971 | Holmos . | |
| 3,789,705 | 2/1974 | Naslund . | |
| 4,762,030 | 8/1988 | Nguyen . | |
| 4,862,773 | 9/1989 | Batten . | |
| 4,869,136 | 9/1989 | Easter et al. . | |
| 5,095,779 | 3/1992 | Batten . | |
| 5,109,735 | 5/1992 | Hart . | |
| 5,438,891 | 8/1995 | Batten . | |
| 5,743,158 | 4/1998 | Perkins . | |

FOREIGN PATENT DOCUMENTS

| | | | |
|---|---|---|---|
| 315927 | 11/1919 | Germany | 81/116 |

*Primary Examiner*—D. S. Meislin

*Attorney, Agent, or Firm*—Kelly Bauersfeld Lowry & Kelley, LLP

[57] ABSTRACT

A fastener removing tool including a driver having a head positioned within a housing which is movable along a longitudinal axis of the housing. Several levers are pivotally mounted within the housing, which each include a fastener-engaging first end extending from the housing and a driver head-engaging second end disposed within the housing and biased toward the driver head. The driver head includes a cone-shaped wedge which engages the second ends of the levers, a thread body that engages the housing, and a shaft which extends from the body for connection to a power tool. Movement of the driver head in the first direction pivots the levers to move the fastener-engaging first ends toward the longitudinal axis and thus onto the fastener, and movement of the driver head in the second direction pivots the levers to move the fastener-engaging first ends away from the longitudinal axis and fastener.

20 Claims, 4 Drawing Sheets

FASTERNER REMOVING TOOL

BACKGROUND OF THE INVENTION

The present invention relates in general to a tool for disassembling threaded fasteners. More particularly, the present invention relates to a tool for removing collars from threaded bolts, such as frangible fasteners used in the aerospace industry.

Frangible fasteners are used extensively in the aerospace industry due to their simplicity, consistently controlled pre-load torque and minimum size and weight. As illustrated in FIG. 1, the fastener basically consists of two parts: a threaded bolt and a threaded nut. The end of the bolt has a configured recess, typically hexagonal, so that an Allen wrench may be inserted to hold the bolt stationary while the nut is rotated. The nut, which is the key component, consists of an internally threaded locking collar which threads onto the bolt. The collar is joined by a grooved neck to a wrenching ring which shears from the collar when the applied torque exceeds a predetermined torsional loading (FIG. 2). The fasteners are applied with one of a variety of wrenching tools which engage the wrenching ring to apply rotational force to the threaded collar and twist the wrenching ring from the threaded collar when the predetermined torsional loading is exceeded. The break-off torque depends on the depth of the groove in the neck which can be selected to meet different torque requirements.

The collar is a relatively smooth surface of revolution, so that once installed it cannot be rotated by conventional wrenches. This design prevents the pre-selected torque from being inadvertently changed. This "tamper proof" feature eliminates torque inspection after installation.

These fasteners are very effective and are intended to be permanently installed. Sometimes, however, the fasteners need to be removed due to any number of reasons including assembly errors or the need to repair the structure. The threaded collar commonly has a cylindrical base which tapers into a smaller diameter cylindrical neck. The cylindrical portions of these collars are narrow and are difficult to grasp with conventional tools such as pliers, vice grip clamps, etc. Although there have been a variety of tools designed to remove these fasteners, many of these tools require a relatively large volume of access space around the collar for removal. However, complex aerospace structures often have such fasteners in locations where access is limited, which prevents the prior removal tools from being effectively utilized.

Other fastener removal tools are hand operated and must be held and operated simultaneously with both hands. They usually require some skill and increase the likelihood of errors and tool slips. The use of such tools for loosening or removing aerospace fasteners is considered undesireable as they can damage the surfaces of the assembled parts.

There have been devised removal tools using a clutch member threadedly received with a collet sleeve which are attachable to a hand or power driven rachet wrench. However, many of these tools are not suitable for use with corroded or otherwise fused fasteners since the grip of the collet fingers about the collar is limited. Other collet removal tools are complicated in design and structure.

Accordingly, there is a need for a fastener removal tool with increased gripping force. A fastener removing tool which can be used in small areas and which will not damage the surfaces of the assembled parts is also needed. Such a tool should be capable of being used in connection with power tools. Furthermore, what is needed is a fastener collar removal tool which is simple in design and structure. The present invention fulfills these needs and provides other related advantages.

SUMMARY OF THE INVENTION

The present invention resides in a fastener removing tool designed to remove frangible aerospace fasteners. The fastener removing tool of the present invention is connectable to power tools and provides increased gripping force for removing particularly stubborn fasteners. The fastener removing tool comprises, generally, a housing having a longitudinal axis, a driver having a head positioned within the housing and movable along the longitudinal axis in first and second directions, and at least one lever pivotally mounted within the housing. The lever includes a fastener-engaging first end extending from the housing and biased away from the longitudinal axis, and a driver head-engaging second end disposed within the housing. Movement of the driver head in the first direction pivots the lever to move its fastener-engaging first end towards the longitudinal axis in order to securely grasp the fastener. Movement of the driver head in the second direction pivots the lever to move its fastener-engaging first end away from the longitudinal axis in order to release the fastener.

The housing includes a harness disposed within a sleeve. The driver head comprises a cone-shaped wedge and a body extending from the wedge. At least a portion of the body is threaded so as to be threadedly received by interior housing threads, allowing movement of the driver along the longitudinal axis of the housing. A longitudinal passageway extends through the driver coaxial with the longitudinal axis of the driver and may be used to insert a hex key into the bolt. A shaft extends from the driver head along the longitudinal axis for connection to a power tool. Pins supported by the housing extend interiorly into the housing such that a portion of the pin is disposed within a peripheral groove defined in the driver head to limit the movement of the driver in the first and second directions.

The driver head-engaging second end of the lever includes a cam surface which engages the cone-shaped wedge of the driver head. The fastener-engaging first end of the lever includes a jaw configured to securely grip the fastener. A spring resiliently biases the driver head-engaging second end of the lever toward the longitudinal axis of the housing. Preferably, there are a plurality of levers which are pivotally mounted within the housing such that a driver head-engaging second end of each lever is biased toward the longitudinal axis of the housing.

In use, the shaft of the driver is connected to a power tool and the driver head is moved in the second direction until the fastener-engaging first ends of the levers fit over the fastener. The driver head is then moved in the first direction causing the cone-shaped wedge of the driver head to engage the tapered driver head-engaging second ends of the levers. As the driver head engages the second ends of the levers, the fastener-engaging first ends of the levers pivot towards the fastener until the jaws securely grip the fastener. This movement continues until the fastener is released from the object. If necessary, the driver head is moved in the second direction until the fastener is released by the jaws.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
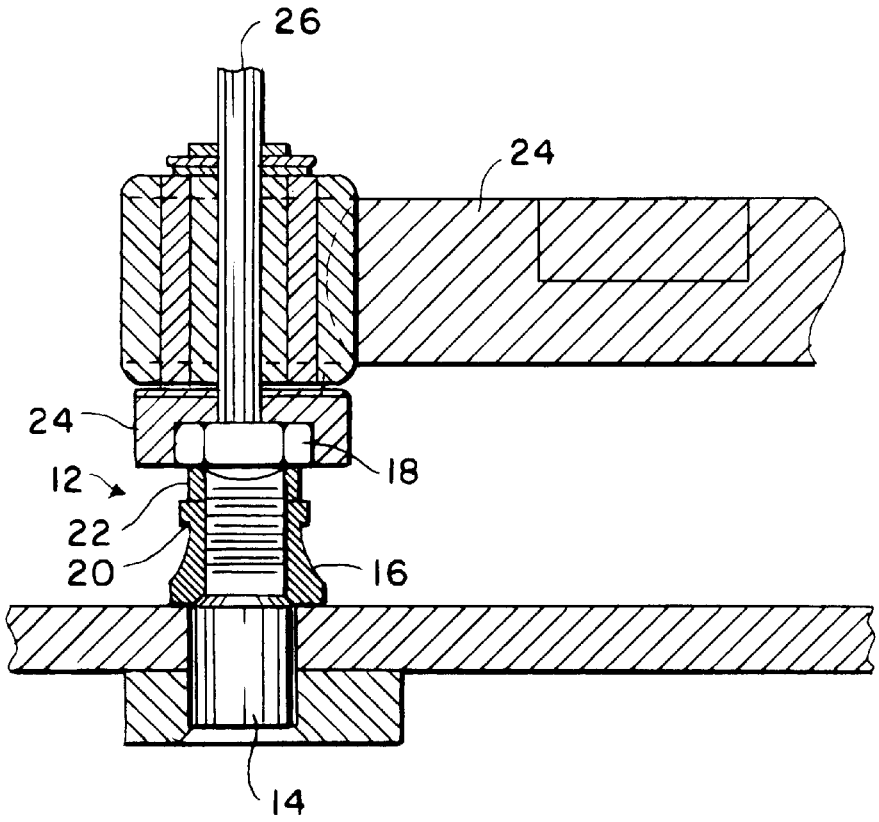
FIG. 1 is a fragmented and partially sectional view of a fastener driving tool and a typical aerospace fastener, wherein the tool engages a frangible ring to secure a nut to a bolt extending through an object.

As shown in the drawings for purposes of illustration, the present invention is concerned with a fastener removal tool, generally referred to by the reference number 10. The tool 10 is used to remove fasteners and is particularly designed to remove torque limited fasteners such as frangible aerospace fasteners 12.

Figure 2:
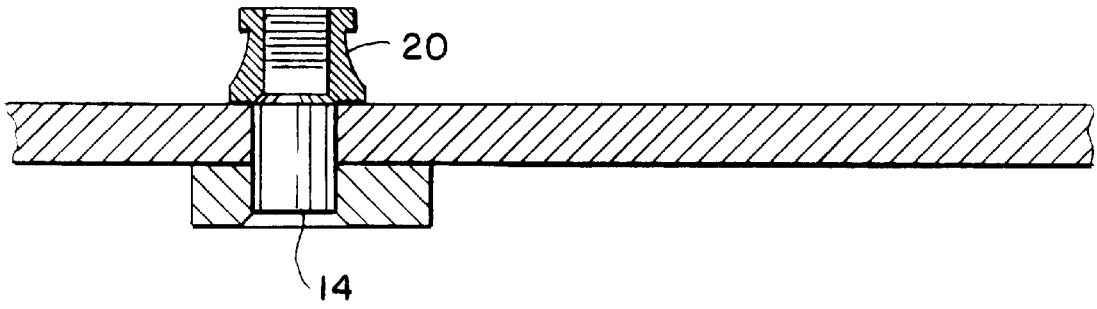
FIG. 2 is a sectional view of the aerospace fastener of FIG. 1, wherein the frangible ring has been sheared off during installation.

An exemplary frangible aerospace fastener 12 and its assembly is Illustrated in FIGS. 1 and 2. As illustrated, the fasteners 12 include a fastener bolt 14 and a fastener nut 16 threadedly received and locked onto the bolt 14. The fastener nut 16 is comprised of wrenching ring 18 which is joined to an internally locking fastener collar 20 by a grooved strain relieved neck 22. The bolt 14 is inserted through the pieces to be joined and the nut 16 is threadedly fastened onto the bolt 14 with a wrenching tool 24 engaged with the typically hexed wrenching ring 18 until the predetermined torque has been applied at which point the wrenching ring 18 will shear from the collar 20 at the grooved neck 22, leaving a relatively smooth surfaced collar 20 locked onto the bolt 14, as illustrated in FIG. 2. In many applications, a supplemental tool such as a hex key or Allen wrench 26 is inserted into a hex recess (not shown) in the end of the bolt 14 to immobilize the bolt 14 during fastening of the nut 16.

Removal of the fastener 12 is difficult due to the smooth surfaces of the collar 20 and the locked relationship between the installed collar 20 and bolt 14. Although the fastener removal tool 10 of the present invention can be used to remove a variety of fasteners, it is particularly designed to remove the installed collar 20 from the fastener bolt 14 of aerospace frangible fasteners 12.

Figure 3:
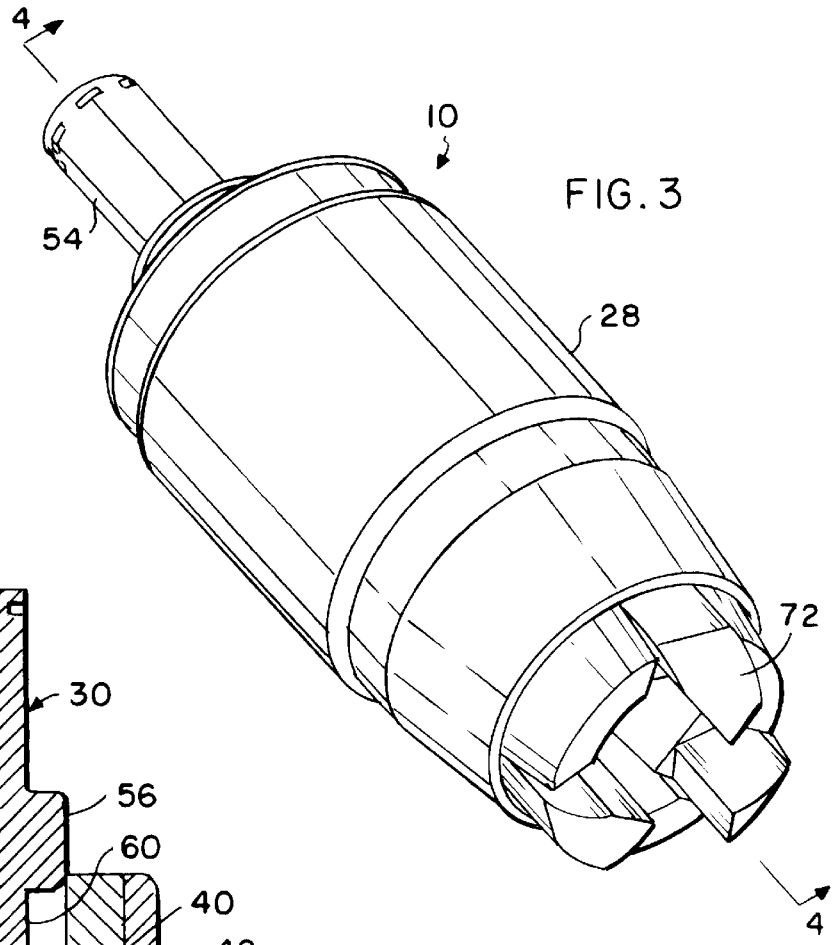
FIG. 3 is a perspective view of a fastener removing tool embodying the present invention.
Figure 4:
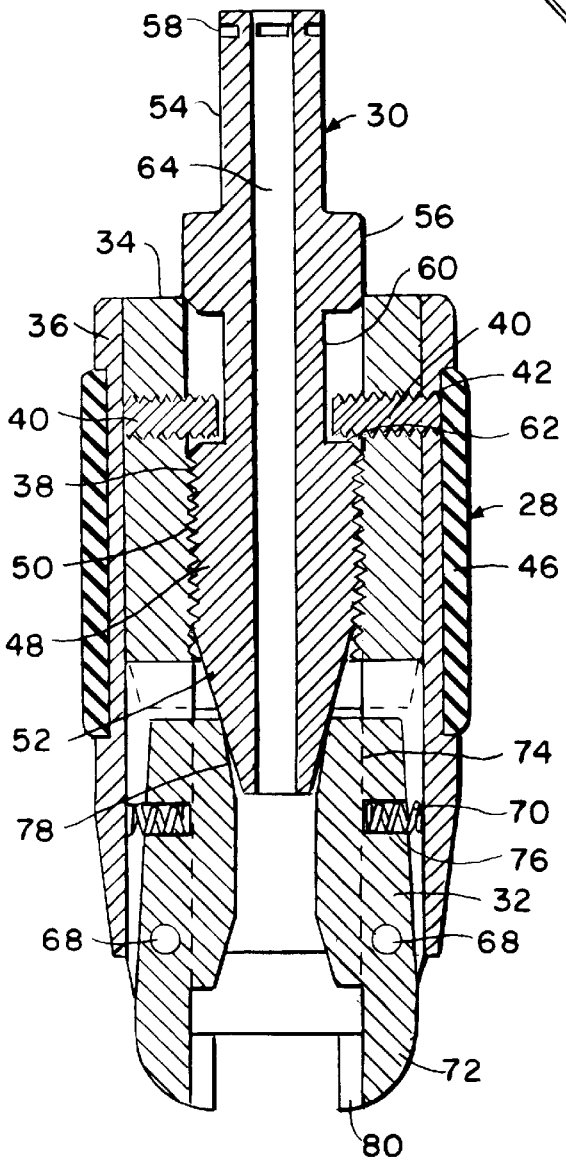
FIG. 4 is a sectional view of the fastener removing tool taken generally along line 4—4 of FIG. 3.
Figure 5:
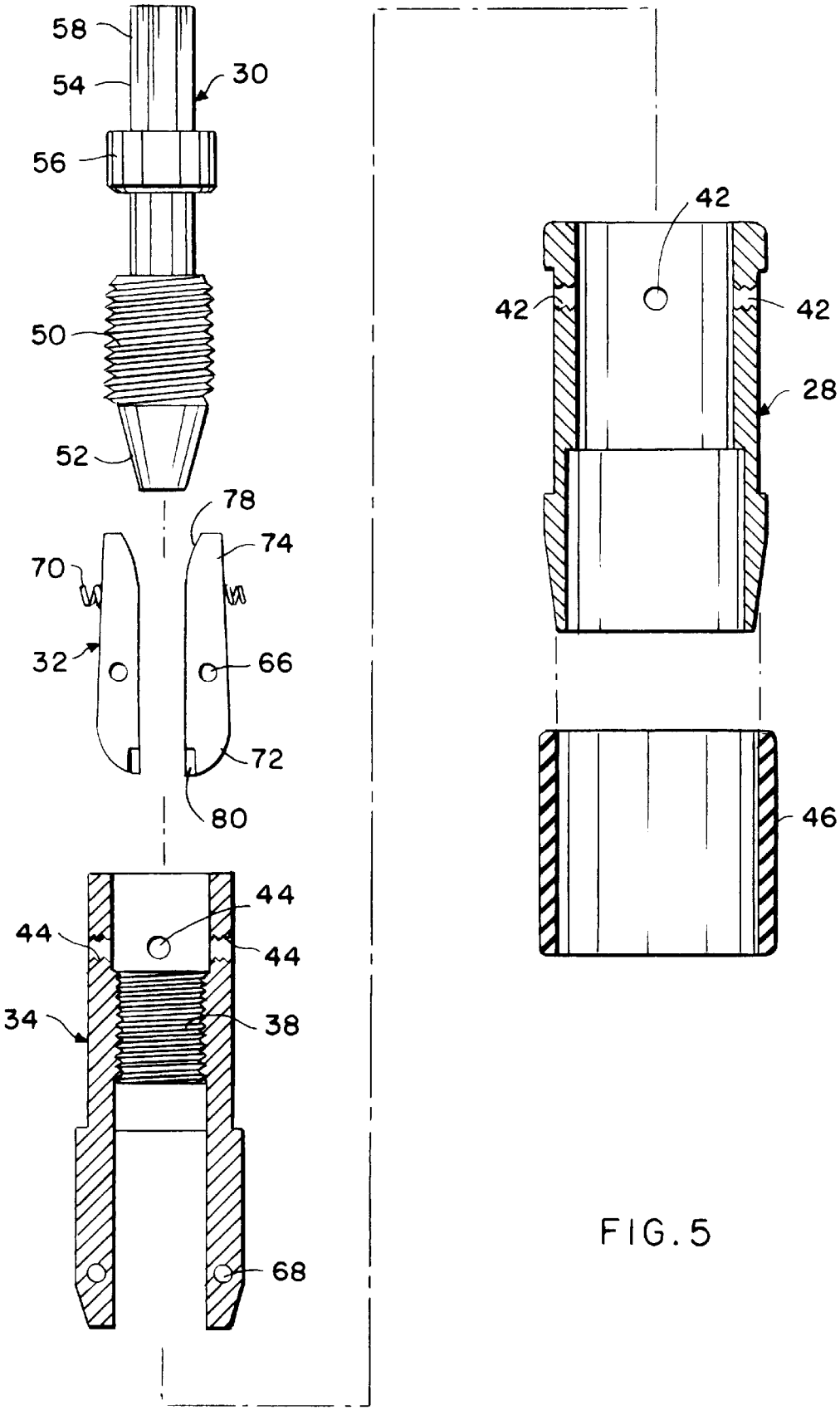
FIG. 5 is an exploded assembly view of the fastener removing tool of FIGS. 3 and 4.
Figure 6:
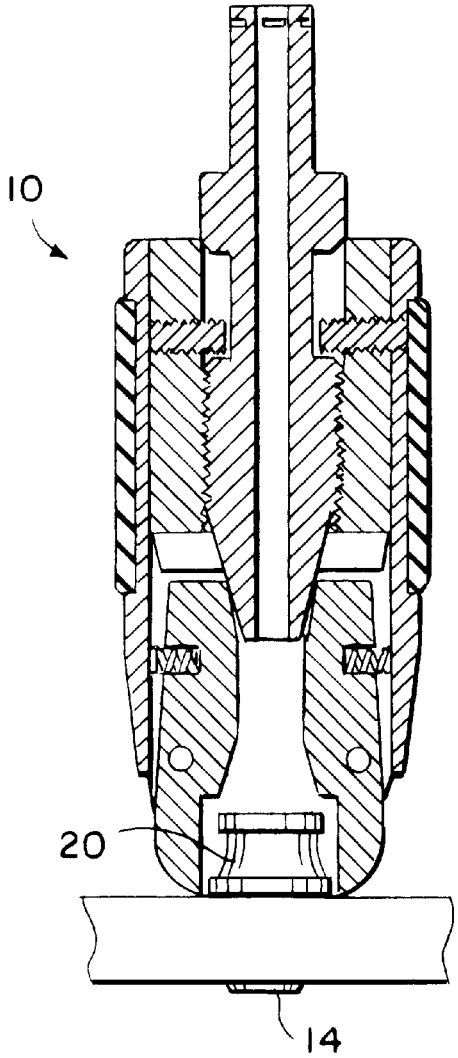
FIG. 6 is a sectional view of the fastener removing tool of FIGS. 3–5, illustrating the placement of jaws over the collar of the aerospace fastener nut.
Figure 7:
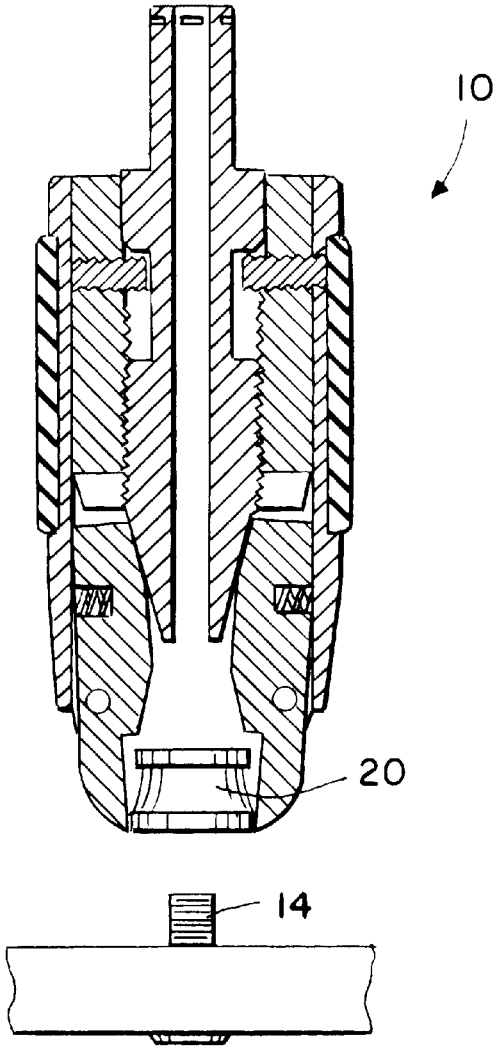
FIG. 7 is a sectional view similar to FIG. 6, illustrating removal of the fastener nut collar from the bolt using the fastener removing tool of the present invention.

With reference to FIGS. 3–5, the tool 10 comprises, generally, a housing 28, a driver 30 positioned within the housing 28 and movable along a longitudinal axis of the housing, and a plurality of levers 32 pivotally mounted within the housing 28. The housing 28 includes a harness 34 positioned within an outer sleeve 36. An interior of the housing 28, typically an interior portion 38 of the harness 34, is threaded. The harness 34 is frictionally fit within the housing 28 and held in place, at least in part, by pins 40 which extend from apertures 42 of the housing 28 into apertures 44 of the aligned harness 34. A hand grip 46 may fit over a portion of the outer sleeve 36 for enhanced gripping and comfort to the user of the tool 10.

The driver 30 is comprised of a head 48 having a threaded body portion 50 and a wedge 52 extending from the threaded body 50. In the preferred form, the wedge 52 is cone-shaped. A shaft 54 extends from the head 48 opposite the wedge 52. A flange 56 extends outwardly from the shaft 54 intermediate the end 58 of the shaft 54 and the head 48 to create a peripheral groove 60. The head of the driver 48 is threaded into the harness 34 and the pins 40 extend through the housing 28 and harness 34 and into the groove 60 between the flange 56 and head 48. Movement of the driver 30 as it extends into or is retracted from the housing 28 is limited by the contact of the pins 40 and either the flange 56 in one direction, or a shelf 62 of the head 48 in the other. The driver 30 includes a longitudinal passageway 64 through the length thereof. The purpose of this passageway 64 will be described later in the description. The end of the shaft 58 is preferably hex shaped so as to connect to a power tool (not shown).

Each lever 32 is mounted in the harness 34 so that the lever 32 can pivot within the housing 28. The lever 32 may be mounted by the use of pins (not shown) which are inserted into apertures 66 and 68 of the lever 32 and harness 34. Springs 70 extend from the lever 32 intermediate first and second ends 72 and 74 of the lever 32 and compressibly contact the outer housing 36 to resiliently bias the lever's driver head-engaging second end 74 toward the longitudinal axis of the housing 28, resulting in the fastener-engaging first end 72 being biased away from the longitudinal axis of the housing 28. The springs 70 may be attached to the lever 32, or fitted within sink holes 76 of the lever 32 so that a portion of the spring 70 extends from the lever 32 for contact with the outer housing 36.

The second ends of the levers 74 have a cam shaped surface 78 so as to increasingly enhance the engagement between the second ends of the levers 74 and the cone-shaped driver wedge 52. With this configuration, when the wedge 52 contacts the second ends of the levers 74, the levers 32 are pivoted only a small amount due to the slight angle of the upper cam surface 78 of each second end 74. However, as the driver head 48 is extended further into the housing 28 the wedge 52 pushes against an increasing angle of the cam surface 78, causing the levers 32 to pivot an increasing amount and the second ends 74 to be forced away from the longitudinal axis of the housing and towards the outer housing 36.

As the second ends of the levers 74 are being pushed away from the longitudinal axis and toward the outer housing 36, the first ends of the levers 72 are pivoted toward the longitudinal axis of the housing, and thus toward one another. Jaws 80 are formed at the first ends of the levers 72. The jaws are configured so as to cooperatively grasp the collar 20 of the fastener 12.

In operation, the driver 30 is retracted from the housing 28 until the jaws 80 of the first ends of the levers 72 can be placed over the fastener collar 20. As mentioned above, the fastener removing tool 10 is preferably connected to a power tool (not shown) at the hexed end of the shaft 58. However, the fastener removing tool 10 can also be used with other hand tools which are capable of engaging the shaft 54 and turning the driver 30. Once the jaws 80 are positioned around the collar 20, the driver head 48 is moved toward the cam surfaces 78 of the second end of the levers 74. As described above, the increasing engagement between the wedge 54 of the driver head 48 and the second ends 74 causes the first ends of the levers 72 to pivot inwardly toward the longitudinal axis of the housing 28. This continues until the jaws 80 securely grip the collar 20 at which point the rotational force applied to the driver shaft 54 by the power tool is no longer translated into linear movement, but rather results in the entire tool 10 having a rotational force applied to it. The force increases until the collar 20 breaks free and is threadedly removed from the bolt 14. The driver head 48 is then moved in the opposite direction to open the first ends of the levers 72 and release the collar 20, if necessary. The combination of the rotational and linear forces and the lever action creates increased gripping force applied to the collar 20 for removal of the fastener 12.

As the locking tension between the collar 20 and bolt 14 may exceed the frictional tension between the bolt 14 and the working surface, the bolt 14 may spin with the collar 20 as it is being rotated by the tool 10. In this case, a hex key or Allen wrench (not shown) may be inserted through the passageway of the driver 64 and into the hex recess of the bolt (not shown) in order to immobilize the bolt 14 while the collar 20 is removed. For particularly stubborn fasteners, a cutter (not shown) may be formed on the first ends of the levers 72 in order to cut or shear the collar 20, and even the bolt 14 from the working surface of the object.

The fastener removing tool 10 of the present invention can be used in narrow corridors as well as flat surfaces. There is no damage to the working surface as the tool 10 does not need to contact the surface while removing the fastener 12. The simple construction and operation of the tool 10 alleviates the need for training operators of the tool. This simplicity also speeds up the fastener removal process as compared to other fastener removal tools.

Although several embodiments have been described in detail for purposes of illustration, various modifications may be made without departing from the scope and spirit of the invention. Accordingly, the invention is not to be limited, except as by the appended claims.

What is claimed is:

1. A fastener removing tool, comprising:

a housing having a longitudinal axis;

a driver having a head positioned within the housing and movable along the longitudinal axis in a first direction and a second direction;

a pin supported by the housing extending interiorly thereof such that a portion of the pin is disposed within a peripheral groove defined in the driver head to limit movement of the driver in the first and second directions; and at least one lever pivotally mounted within the housing, the lever including a fastener-engaging first end extending from the housing and biased away from the longitudinal axis, and a driver head-engaging second end disposed within the housing;

wherein movement of the driver head in the first direction pivots the lever to move its fastener-engaging first end towards the longitudinal axis, and movement of the driver head in the second direction pivots the lever to move its fastener-engaging first end away from the longitudinal axis.

2. The tool of claim 1, wherein the driver head comprises a wedge at one end thereof and a body extending from the wedge.

3. The tool of claim 2, wherein the wedge is cone shaped.

4. The tool of claim 2, wherein at least a portion of the body of the driver head is threaded for reception by interior threads of the housing.

5. The tool of claim 4, wherein the driver includes a shaft which extends from the driver head along the longitudinal axis.

6. The tool of claim 5, including a longitudinal passageway through the driver formed coaxially with the longitudinal axis.

7. The tool of claim 1, wherein the at least one lever comprises a plurality of levers pivotally mounted within the housing such that the driver head-engaging second end of each lever is resiliently biased toward the longitudinal axis of the housing.

8. The tool of claim 1, wherein the driver head-engaging second end of the at least one lever includes a cam surface which engages the driver head.

9. The tool of claim 1, including a spring which biases the driver head-engaging second end of the lever toward the longitudinal axis of the housing.

10. The tool of claim 1, wherein the fastener-engaging first end of the at least one lever includes a jaw configured to securely grip the fastener.

11. The tool of clam 1, wherein the housing includes a harness disposed within a sleeve.

12. A fastener removing tool, comprising:

a housing having a longitudinal axis;

a driver having a head threadedly positioned within the housing and movable along the longitudinal axis in a first direction and a second direction;

a pin supported by the housing extending interiorly thereof such that a portion of the pin is disposed within a peripheral groove defined in the driver head to limit movement of the driver in the first and second directions; and a plurality of levers pivotally mounted within the housing, the levers each including a fastener-engaging first end extending from the housing and biased away from the longitudinal axis, and a driver head-engaging second end disposed within the housing;

wherein movement of the driver head in the first direction pivots the levers to move the fastener-engaging first ends towards the longitudinal axis, and movement of the driver head in the second direction pivots the levers to move the fastener-engaging first ends away from the longitudinal axis.

13. The tool of claim 12, wherein the driver head comprises a cone-shaped wedge at one end thereof, a body extending from the wedge, and a shaft which extends from the driver head along the longitudinal axis opposite the wedge.

14. The tool of claim 13, including a longitudinal passageway through the driver formed coaxially with the longitudinal axis.

15. The tool of claim 12, wherein the driver head-engaging second ends of the levers each include a cam surface which engages the driver head, and wherein the fastener-engaging first ends of the levers each include a jaw configured to securely grip the fastener.

16. The tool of claim 12, including a spring associated with each lever for resiliently biasing the driver head-engaging second ends of each lever toward the longitudinal axis of the housing.

17. The tool of claim 12, wherein the housing includes a harness disposed within a sleeve.

18. A fastener removing tool, comprising:

a housing having a longitudinal axis and including a harness disposed within a sleeve;

a driver threadedly positioned within the harness and movable along the longitudinal axis in a first direction and a second direction, the driver having a head and a shaft which extends therefrom along the longitudinal axis, the driver head defining a peripheral groove and including a cone-shaped wedge at one end thereof and a threaded body;

a plurality of levers pivotally mounted within the harness, the levers each including a fastener-engaging first end extending from the housing and having a jaw configured to securely grip a fastener, and a driver head-engaging second end disposed within the housing;

springs disposed between the harness and each lever for resiliently biasing the driver head-engaging second ends of the levers toward the longitudinal axis; and a plurality of pins extending interiorly from the harness into the peripheral groove of the driver to limit movement of the driver in the first and second directions;

wherein movement of the driver head in the first direction pivots the levers to move the fastener-engaging first ends towards the longitudinal axis, and movement of the driver head in the second direction pivots the levers to move the fastener-engaging first ends away from the longitudinal axis.

19. The tool of claim 18, wherein the driver includes a shaft which extends from the driver head along the longitudinal axis and a longitudinal passageway through the driver formed coaxially with the longitudinal axis.

20. The tool of claim 19, wherein the driver head-engaging second ends of the levers each includes a cam surface which engages the driver head.

* * * * *